US005819484A

United States Patent [19]

Kar

[11] Patent Number: 5,819,484

[45] Date of Patent: Oct. 13, 1998

[54] BUILDING STRUCTURE WITH FRICTION BASED SUPPLEMENTARY DAMPING IN ITS BRACING SYSTEM FOR DISSIPATING SEISMIC ENERGY

[76] Inventor: Ramapada Kar, 2978 Albion Drive, Coquitlam, British Columbia, Canada, V3B 6M5

[21] Appl. No.: 508,903

[22] Filed: Jul. 28, 1995

[51] Int. Cl.[6] ..... E04H 9/02

[52] U.S. Cl. ..... 52/167.3; 52/167.1

[58] Field of Search ..... 52/167.1, 167.2, 52/167.3, 167.7, 167.8

[56] References Cited

U.S. PATENT DOCUMENTS

| | | | |
|---|---|---|---|
| 2,053,226 | 9/1936 | Ruge | 52/167.1 X |
| 3,418,768 | 12/1968 | Cardan | 52/167.1 |
| 4,910,929 | 3/1990 | Scholl | 52/167.3 |
| 5,456,047 | 10/1995 | Dorka | 52/167.1 X |

FOREIGN PATENT DOCUMENTS

| | | | |
|---|---|---|---|
| 0 349 979 B1 | 7/1988 | European Pat. Off. . | |
| 240340 | 9/1990 | Japan | 52/167.2 |
| 187151 | 7/1993 | Japan | 52/167.2 |
| 248117 | 9/1993 | Japan | 52/167.1 |
| 302451 | 11/1993 | Japan | 52/167.1 |
| 311925 | 11/1993 | Japan | 52/167.1 |
| 26236 | 2/1994 | Japan | 52/167.1 |
| 26237 | 2/1994 | Japan | 52/167.1 |
| 207479 | 7/1994 | Japan | 52/167.1 |
| 1791610 | 1/1993 | U.S.S.R. | 52/167.1 |

OTHER PUBLICATIONS

*Earthquake Spectra*, The Professional Journal of the Earthquake Engineering Research Institute, Aug. 1993 vol. 9, No. 3, pp. 334–371, 466–489.

*Primary Examiner*—Michael Safavi

*Attorney, Agent, or Firm*—Shlesinger, Arkwright & Garvey LLP

[57] ABSTRACT

A building structure includes one or more friction spring energy dissipating units installed as part of its bracing system, each unit including surfaces in frictional contact for dissipating seismic energy. Various bracing configurations are possible. A friction spring energy dissipating unit for such installations includes first and second connections plates at opposed ends of the unit and a friction spring stack supported between the ends within a housing. Both tension and compression forces applied to the connection plates are transmitted to the stack as compression forces.

3 Claims, 5 Drawing Sheets

BUILDING STRUCTURE WITH FRICTION BASED SUPPLEMENTARY DAMPING IN ITS BRACING SYSTEM FOR DISSIPATING SEISMIC ENERGY

FIELD OF THE INVENTION

This invention relates to the protection of building structures against damage from earthquake activity. More particularly, the present invention relates to building structures having a bracing system which includes friction based supplementary damping to dissipate seismic energy.

Herein, the term "building" or "building structure" includes not only structures intended for use as dwellings or places of work, but also other fixed structures such as bridges, overpasses and the like designed for human occupancy or to carry the weight of human users.

BACKGROUND TO THE INVENTION

In the current practice of earthquake design, seismic design forces in structural members of building frameworks are typically reduced to elastic range. Then, in the event of a major earthquake, inelastic response at selected locations will dissipate a substantial amount of energy to prevent structural collapse. Such selected locations are known as "hinge locations" and are specially designed for hinge formation. Typically, although not always, hinge locations will be limited to the ends of structural beams.

The yielding which occurs at hinge locations in order to dissipate seismic energy may imply considerable damage to structural members. Moreover, in a multi-story building, for example, the relative lateral displacements between floors (viz. the storey drifts) required to produce hinges at prescribed locations may be large enough to cause substantial damage to non-structural elements such as partitions, in-fill walls, ceilings, and window glass. Following an earthquake, the cost of repair to upgrade the structure to current building code requirements may be substantial. In some cases, such repair may not be practical or possible.

One of the approaches used to overcome the foregoing drawback in conventional seismic design has been to incorporate supplementary damping devices or energy dissipating units (EDUs) into the earthquake resistance system of buildings. Such devices introduce additional damping into the structure thereby reducing earthquake induced forces.

The operation of one class of such EDUs is based on friction between adjacent surfaces. For example, one such EDU is a friction damper developed by Sumitomo Metal Industries Ltd., Japan: see Earthquake Spectra, Volume 9, No. 3, at pp 338–39, August 1993, Theme Issue: Passive Energy Dissipation, Earthquake Engineering Research Institute, Oakland, Calif. As described in this paper, the Sumitomo damper is a cylindrical device with friction pads that slide directly on the inner surface of a steel casing for the device. They are attached to the underside of floor beams and connected to Chevron brace assemblages.

Another type of EDU is the "Pall Friction Device" also described in the foregoing issue of Earthquake Spectra (op cit. p. 345). As described, this device comprises diagonal brace elements, with a friction interface at their intersection point, which are connected together by horizontal and vertical link elements. The link elements ensure that when the load applied to the device via the braces is sufficient to initiate slip on the tension diagonal, then the compression diagonal will also slip an equal amount in the opposite direction. The paper notes that the friction resistance of the device requires a normal force on the sliding interface, and that this is achieved through a bolt at the intersection of the diagonal arms.

A further type of EDU described in the foregoing issue of Earthquake Spectra (op cit. p. 354) is a friction-slip device (FSD). As described, the FSD comprises two U-shaped steel casings and a sliding piece located between the casings. The interface between the inner and outer pieces is faced with a high performance brake-pad material, and the normal force to the friction surface is developed by pre-stressed bolts.

A still further type of EDU described in the foregoing issue of Earthquake Spectra (op cit. p. 358 and p.468) is an energy dissipating restraint (EDR). As described, the mechanism of the EDR is sliding friction through a range of motion with a stop at the end of the range. The principal components are an internal spring, compression wedges, friction wedges, stops and a cylinder housing. In operation, the compressive force in the spring acting on the compression and friction wedges causes a normal force on the cylinder wall. The normal load and the coefficient of friction between the friction wedges (bronze) and the cylinder wall (steel) determine the slip force in the device. As described, features of the EDR include a self-centering capability and a frictional force which is proportional to displacement.

For a given EDU at a given location in the bracing system of a building, an enormous amount of complex analytical work may be required in order to determine what the slip load should be in that location. When the required load is established, the friction surfaces need to be preloaded in order to achieve the desired performance.

There are a number of problems or concerns with EDUs of the type described above. These include:

- to ensure that the contact forces between sliding surfaces do not change during the long intervals between earthquakes;
- to ensure that the co-efficient of friction does not change;
- for some devices, the structure may not always return to pre-earthquake status after a strong motion earthquake.

Accordingly, a primary object of the present invention is to avoid or alleviate such problems through the provision of a new and improved building structure which incorporates in its bracing system friction based supplementary damping means which is relatively insensitive to external forces that may impair desired performance.

A further object of the present invention is to provide a building structure which incorporates a friction based supplementary damping means which exhibits reliable, stable and repeatable performance characteristics, and which is relatively maintenance free.

A still further object of the present invention is that such supplementary damping means should be adaptable not only for new building designs but also for retrofitting structures previously damaged by earthquake activity and for upgrading existing buildings to meet higher building code requirements.

SUMMARY OF THE INVENTION

In a broad aspect of the present invention, there is provided a building structure including a framework and one or more friction spring energy dissipating units fixedly connected from opposed ends of the unit to the framework for providing lateral load resistance for the structure.

Each energy dissipating unit includes surfaces in frictional contact for frictionally dissipating seismic energy during earthquake activity.

In a preferred embodiment, each friction spring EDU comprises first and second connection plates at its opposed ends for fixedly connecting the unit in the bracing system. A friction ring stack is supported between the ends within a housing, the stack comprising a plurality of friction spring rings stacked with axial alignment around a longitudinal axis extending between the ends. Each friction spring ring has conical surface frictional contact with each adjacent friction spring ring. Further, the unit includes means for transmitting both axial compression and axial tension forces applied at the ends of the unit from the ends to the stack as axial compression forces on the stack.

Typically, the stack will comprise a plurality of inner friction spring rings interdigitated with a plurality of outer friction spring rings around the longitudinal axis. Each of the inner rings will have at least one radially outward facing conical surface in frictional contact with a corresponding radially inward facing conical surface of an adjacent one of said outer rings.

Herein, where reference is made to friction rings in the context of being part of a friction spring, the reference will often read "friction spring rings" in order to emphasize the fact that the friction rings are the elements which define the spring characteristics of a friction spring—and to differentiate from friction rings which do not serve to define any spring characteristic.

The friction spring EDU may form a bracing member in and of itself in the bracing system of a building structure, or it may form a part of a bracing member. For example, in a building structure having a vertical load resisting framework comprised of vertical columns and intersecting horizontal beams, such a unit may have the connection plate at one of its ends bolted directly to one of the vertical columns and the connection plate at the opposed end bolted directly to one of the horizontal beams (viz. as a knee brace). As such, the unit may be viewed as a bracing member in and of itself. Alternately, if the connection plates of the unit were bolted to corresponding connection plates mounted on the vertical column and the horizontal beam, then the unit together with the corresponding connection plates may be viewed as the bracing member.

Various bracing configurations are possible. Depending upon the configuration, the friction spring EDUs may form part not only of bracing members which include corresponding connection plates as noted above, but also bracing members which include elongated bracing segments (as, for example, in a diagonal brace).

Such a building structure incorporating friction spring EDUs has a marked advantage over structures incorporating conventional friction based EDUs of the type previously described. Specifically, the properties and characteristics of the friction spring EDU will be relatively insensitive to any change in forces applied to the device as time passes. Further, in a friction spring EDU fabricated, from steel the coefficient of friction will be relatively stable. Further, if the contact force between conical contact surfaces does change, the resultant effect on performance will be relatively minimal. Moreover, and together with the foregoing features, the friction spring EDU will be self-centering.

A friction spring EDU can be well suited for the bracing system of a building for additional reasons. Firstly, for a high load carrying capacity, the friction spring EDU can be made relatively small and compact. Secondly, its performance is relatively insensitive to temperature, and it can work without loss of efficiency in temperatures as low as −50° C. Such temperature insensitivity may be important depending upon a building's environment, and may be difficult to achieve with other EDUs where energy dissipation may depend upon interaction between differing components such as cylinder or casing walls and wedges or pads having differing sizes and geometries and differing materiel construction. Thirdly, damping performance is largely a function of amplitude with energy dissipation being about 66% of the energy input.

It should be noted that friction spring devices per se are not new. They have been known and available in the marketplace for many years. Also known as "ring springs", one manufacturer of friction springs is Ringfeder GmbH in Germany. Typically, they have been used in applications where the dissipation of impact energy is desired, a common example being rail car buffers. Other applications include automotive components, mechanical equipment and electrical equipment. However, they have also been used to reduce structural vibration.

A known example of the use of friction springs to reduce vibration is disclosed in European Patent No. EP 0 349 979 B1 (Nonhoff) granted to Ringfeder GmbH. In this case, the vibration of free standing structures such as steel stacks, antenna towers, concrete towers, cable or pipeworks is reduced by connecting a damper mass (auxiliary mass) to the structure through friction spring and damping elements. However, it will be noted that the damper mass and friction springs are not part of a bracing system for the structure. The damper mass is hung as a pendulum which, working in collaboration with the damping provided by friction springs, serves to reduce vibration. In effect, the device is a tuned mass damper.

The invention will now be further described with reference to the drawings wherein preferred embodiments are shown. The specifics illustrated in the drawings are intended to exemplify, rather than limit, aspects of the invention as defined in the claims.

DETAILED DESCRIPTION

Figure 1A:
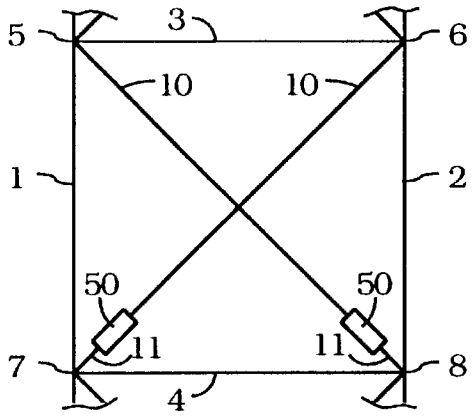
FIGS. 1(*a*) to 1(*f*) illustrate a portion of building frameworks with various bracing configurations incorporating friction spring EDUs in accordance with the present invention.
Figure 1B:
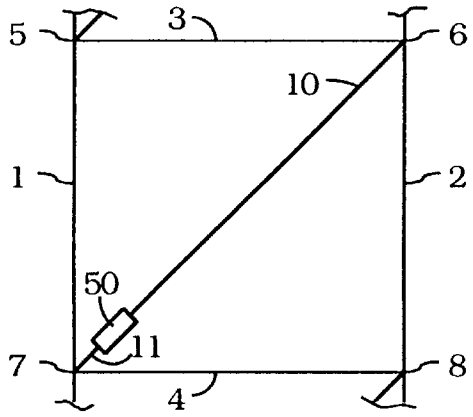
Figure 1C:
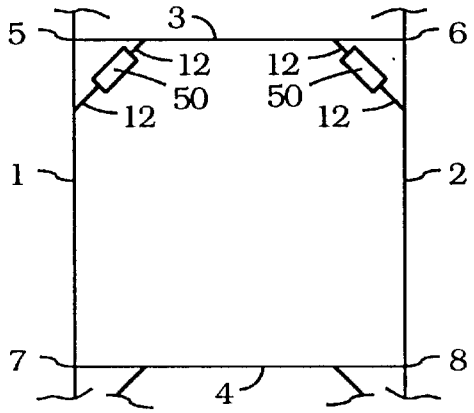
Figure 1D:
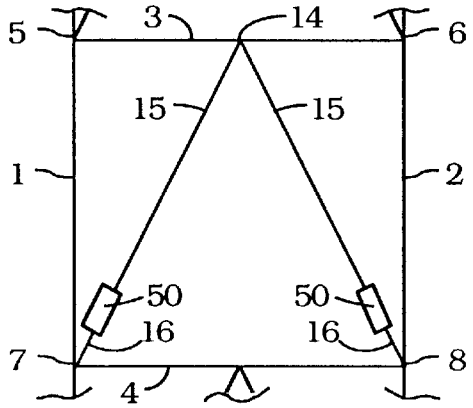
Figure 1E:
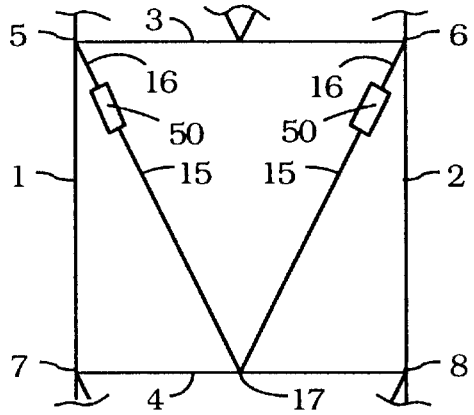
Figure 1F:
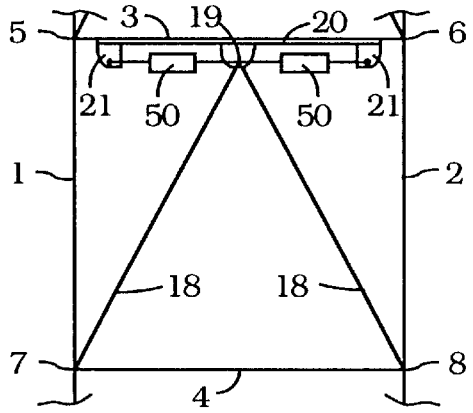

FIGS. 1(*a*) to 1(*f*) illustrate a variety of bracing systems in a building structure with a framework comprising spaced first and second vertical columns 1, 2 and spaced upper and lower horizontal beams 3, 4 interconnecting with the vertical columns at intersections 5, 6, 7, 8 in a conventional manner. The primary purpose of such columns and beams is to provide gravity load resisting support. In each case, primary purpose of the associated bracing system is to provide lateral load resistance for the structure.

Apart from the inclusion of one or more friction spring EDUs generally designated 50 in each of the bracing systems, the structures illustrated in FIGS. 1(*a*) to 1(*f*) are conventional in design and construction. Accordingly, design and construction details of the frameworks and the bracing systems apart from the EDUs are not shown and will not be described in detail.

In FIG. 1(*a*), a pair of bracing members, each member comprising a friction spring EDU 50, an elongated diagonally extending brace segment 10, and a diagonally extending link 11, are arranged to form a cross-brace. Segments 10 serve to interconnect the top ends of EDUs 50 to the framework substantially at intersections 5, 6. These connections may be made utilizing conventional means (not shown) such as connection plates or the like, carried by the framework at or near the intersections. Or, for example, and depending upon construction details, these connections may be made in a more direct manner by attaching (e.g. by bolting) segments 10 directly to one of the intersecting horizontal beams or vertical columns at or near intersections 5, 6.

Each link 11 in FIG. 1(*a*) serves as means for connecting the bottom end of its corresponding EDU 50 to the framework at or near an intersection 7, 8 (as the case may be) on a diagonal line with its corresponding brace segment 10. Depending upon the proximity of the EDUs to these intersections, link 11 may include a relatively short brace segment which extends diagonally downward from the EDU to connect with the framework in like manner as brace segment 10. Or, if the EDUs are positioned sufficiently close to intersections 7, 8, the bottom end of each EDU may be connected directly to the framework or to a gusset plate or the like attached to the framework.

In FIG. 1(*b*), bracing members are arranged to form a single diagonal brace of the type shown in FIG. 1(*a*). While a cross-brace arrangement as shown in FIG. 1(*a*) will provide added supplementary damping, a given building structure depending upon design criteria may not require such added protection, or it may not be configured to install or to easily install a cross-brace.

In FIG. 1(*c*), EDUs 50 are installed in a pair of knee braces. One end of each EDU is connected by means of a link 12 to one of the vertical columns 1, 2. Likewise, the other end of each EDU is connected by means of a link 12 to upper horizontal beam 3. A knee bracing arrangement may be considered particularly desirable in retrofitting situations in order to minimize the disturbance of non-structural elements such as walls, etc. while gaining access to a building framework.

In FIGS. 1(*d*) and 1(*e*), bracing members are arranged to form chevron braces; the structure shown in FIG. 1(*d*) having a fixed apex connection 14 to upper horizontal beam 3 at a location midway between vertical columns 1, 2; the structure shown in FIG. 1(*e*) having a fixed inverted apex connection 17 to lower horizontal beam 4 at a location likewise midway between vertical columns 1, 2. Each leg of these chevron braces includes a friction spring EDU 50 and a diagonally extending brace segment 15. In the case of FIG. 1(*d*), brace segments 15 serve to connect the top ends of EDUs 50 to beam 3 at apex 14. In the case of FIG. 1(*e*), brace segments 15 serve to connect the bottom ends of EDUs 50 to beam 4 at inverted apex 17. The connections of brace segments 15 to horizontal beam 3 or 4, as the case may be, can be made in a conventional manner utilizing bracing members (not shown) such as gusset plates or the like carried by the associated horizontal beam, and which form part of the bracing system. Or, and again depending upon the details of construction, brace segments 15 may be connected more directly (e.g. by bolting) to the associated horizontal beam.

Each leg of the chevron braces shown in FIGS. 1(*d*) and 1(*e*) also includes a relatively short link 16, the basic attributes of which are essentially the same as link 11 in FIG. 1(*a*).

FIG. 1(*f*) illustrates a different form of chevron brace mounted to upper horizontal beam 3. This chevron brace comprises a pair of brace segments 18 which extend downwardly to intersections 7 and 8, respectively, from an apex rail connection 19 on the underside of a mounting beam 20. Beam 20 is in turn mounted below and extends parallel to beam 3. As can be seen, connection 19 lies at a location midway between vertical columns 1, 2. The chevron brace shown in FIG. 1(*f*) also includes a pair of friction spring EDUs 50, each having one end connected to connection 19 and an opposed end connected to beam 20 at a location horizontally away from connection 19 by means of a connection plate 21 mounted on beam 20.

In the bracing structures shown in FIGS. 1(*a*) to 1(*f*), EDUs 50 play a passive role. However, in the event of earthquake activity which for example, may tend to distort the frameworks from the rectangular configurations shown to parallelogram configurations where the frameworks tilt left or right, then the EDUs acting under tension or compression will absorb seismic energy and dissipate that energy as heat. For example, in the case of FIG. 1(*b*), a parallelogram tilt to the right would draw EDU 50 into tension. Conversely, a parallelogram tilt to the left would force EDU 50 in FIG. 1(*b*) into compression. The characteristics of EDU 50 under tension and compression will become more apparent in the discussion which follows with reference to FIGS. 2 to 6.

Figure 2:
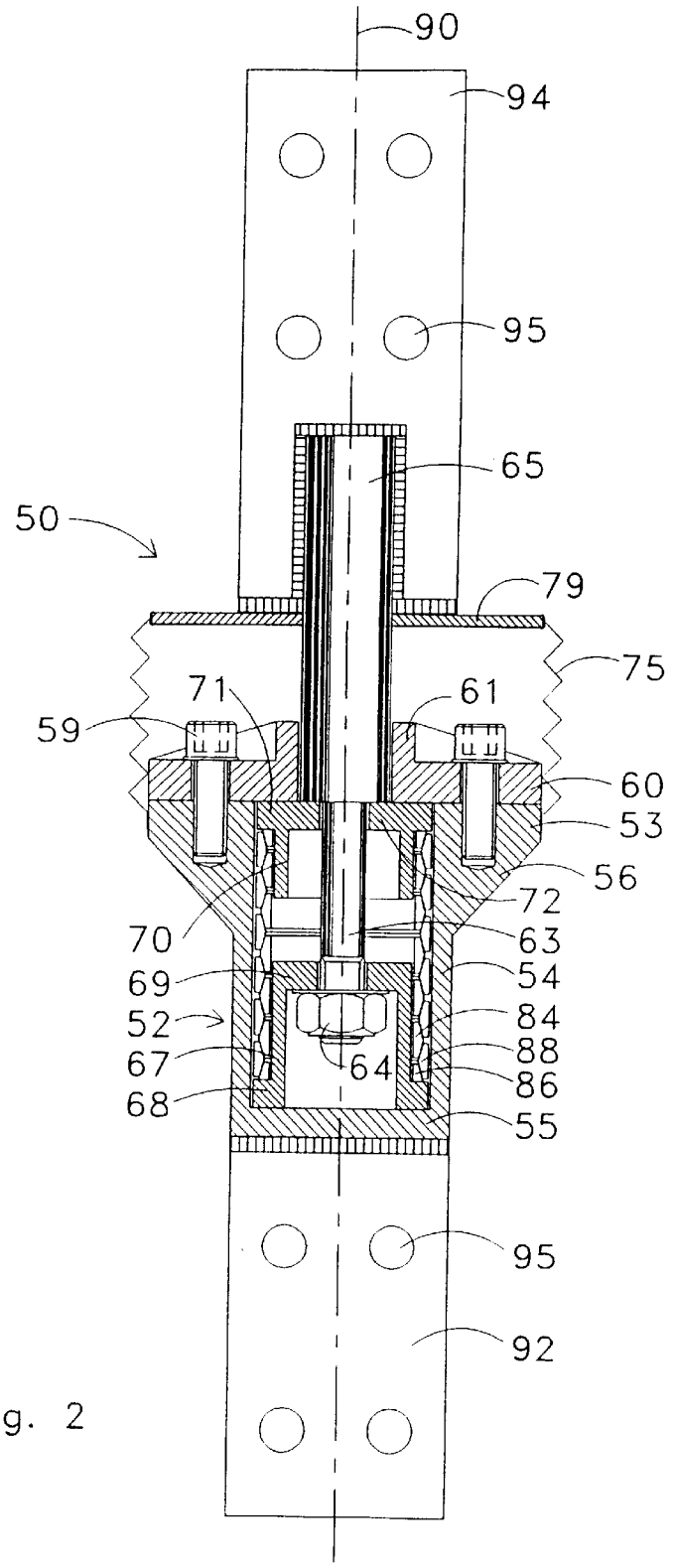
FIG. 2 is an elevation view, partially in section of a friction spring EDU adapted for use in the bracing system of a building structure.

Referring now to FIG. 2, EDU 50 includes opposed ends 92, 94, each formed by a connection plate or bar, and a friction ring stack supported between the ends within a housing generally designated 52. Housing 52 has a stepped cylindrical configuration which includes an upper cylindrical portion 53, a lower cylindrical portion 54, with a solid conical transition 56 therebetween. Bars 92, 94 include holes 95 to enable EDU 50 to be connected by means of bolts (not shown) in the bracing system of a building. The friction ring stack is composed of a plurality of inner friction spring rings 84 interdigitated with a plurality of outer friction spring rings 88 around a longitudinal axis 90 which extends between bars 92, 94. As well, the stack includes two half friction spring rings 86; one positioned at the top of the stack, the other positioned at the bottom of the stack.

Figure 3:
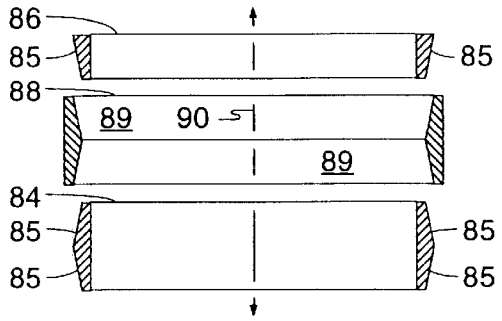
FIG. 3 is an exploded section elevation view showing inner and outer rings of the friction ring stack in the friction spring EDU in FIG. 2.

As best illustrated in FIG. 3, which shows an exploded view of the top three rings in the friction ring stack, each inner ring 84 has two radially outward facing conical surfaces 85 in frictional contact with a corresponding radially inward facing conical surface 89 of one of the outer rings 88. Each half ring 86, which may also be characterized as an inner ring or inner half ring, has a single radially outward facing conical surface 85 in frictional contact with a corresponding radially inward facing conical surface 89 of one of the outer rings.

Referring again to FIG. 2, EDU 50 includes a stiffened circular end plate 60 mounted by means of cap screws or fasteners 59 to upper portion 53 of housing 52. A tie rod 63, with a nut 64 threaded at its lower end, extends upwardly along axis 90, through a tensioning cup 67 and guide tube 70 to join with the bottom of a thrust rod 65 at the top of guide tube 70. Thrust rod 65 then extends upwardly along axis 90 slidably through collar 61 of end plate 60 to connection bar 94 where it is welded with the bar. At the opposed end of EDU 50, connection bar 92 is welded directly to bottom end 55 of housing 52.

Tensioning cup 67, contained within lower portion 54 of housing 52, extends upwardly within the friction ring stack, and includes a lower radially outwardly extending flange 68 to bear upwardly on the bottom surface of lower half ring 86 in the stack. Guide tube 70, contained partially within upper cylindrical portion 53 of housing 52, and partially within the region tapering to lower cylindrical portion 54, extends downwardly within the friction ring stack, and includes an upper radially outwardly extending flange 71 to bear downwardly on the upper surface of upper half ring 86 in the stack.

Note that the diameter of outer rings 88 is toleranced inwardly from housing 52. Likewise, the diameter of inner rings 86, 88 is toleranced outwardly from tensioning cup 67 and guide tube 70. These conditions of tolerance are designed to be satisfied over the full ranges of both loading and temperature to which EDU 50 may be exposed. Thus, operation does not depend upon frictional contact with cylinder walls or the like, and can occur over a broad range of temperatures.

Nut 64 on tie rod 63 permits a predetermined amount of compression or prestress to be applied along the axis 90 of friction spring rings 84, 86, 88. When nut 64 is tightened against top end 69 of cup 67, flange 68 is drawn upwardly against the bottom of the friction ring stack. Concurrently, flange 71 of guide tube 70 is forced downwardly against the top of the friction ring stack. This action occurs because the bottom of thrust rod 65 is being drawn against radially inwardly extending flange 72 of guide tube 70.

Prestress is applied to the friction ring stack outside housing 52 during assembly of EDU 50. At this time, it will be desirable to make a one time application of lubricant between the friction spring ring interfaces. Such lubricant should affect the coefficient of friction only slightly, and will serve to keep the friction spring operational at temperatures as low as −50° C. Further, to provide long term resistance to corrosion, it will be desirable to provide lubrication within the housing which covers the surfaces of the friction ring stack.

The purpose of prestress in the friction spring rings of EDU 50 is not to establish a slip load as with other types of EDUs. Rather, the purpose is to align and hold rings 84, 86 and 88 in a column stack centered on axis 90. Generally, it is considered that this purpose will be served if the stack is prestressed to about 5% to 10% of the maximum force which the stack is designed to carry during earthquake activity.

The fabrication and assembly details of EDU 50 are designed to ensure that the friction ring stack in the EDU will always be in compression. For example, if building bracing members (not shown) connected at ends 92, 94 impose a compression force between such ends in response to earthquake activity, then the stack will be under compression because the force will be transmitted via thrust rod 65 and flange 71 of guide tube 70 to act downwardly from the top of the stack while the bottom of the stack is braced against bottom end 55 of housing 52 via flange 68 of tensioning cup 67. Conversely, if such bracing members impose a tension force between the ends, then the friction ring stack will be still be under compression. In this case, the friction ring stack will be under compression because tension force will be transmitted via thrust rod 65, tie rod 63 and nut 64, tensioning cup 67 and its flange 68, to act upwardly from the bottom of the stack. Concurrently, the top of the stack is braced against end plate 60 via flange 71 of guide tube 70.

As can be seen in FIG. 2, EDU 50 also includes a bellow 75 which is attached by gluing at its lower end to housing 52 and, at its upper end, to circular sealing or bellow plate 79 having approximately the same diameter as upper end 53 of housing 52. Plate 79 is carried by and welded with both thrust rod 65 and bar 94. Bellow 75 and plate 79 advantageously provides a hermetic seal for the interior of EDU 50 against dust or other foreign particles.

Figure 4:
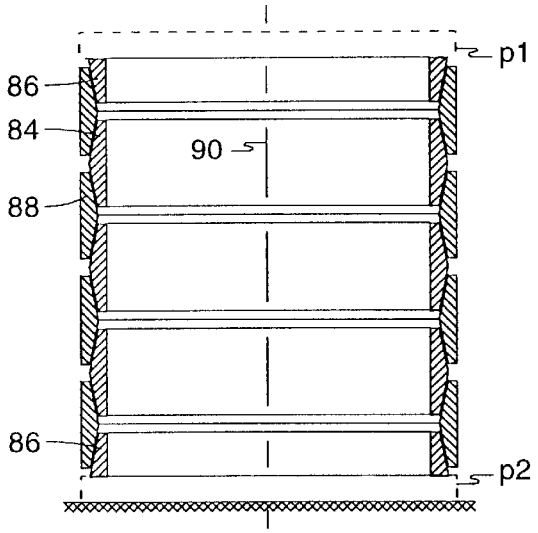
FIG. 4 is a section elevation view of the friction ring stack in FIG. 2 in an unloaded condition.
Figure 5:
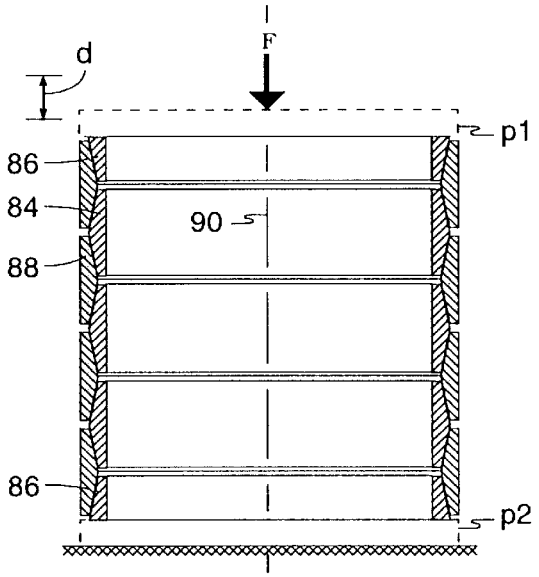
FIG. 5 is a section elevation view of the friction ring stack in FIG. 4 in a loaded condition.

The response of the friction ring stack to an applied force F (which may result from either tension or compression applied to EDU 50) is illustrated by FIGS. 4 and 5. In these Figures, elements of EDU 50 other than friction spring rings 84, 86, 88 are not shown. For simplicity, the stack is illustrated as being supported between a pair of plates p1, p2, shown in broken outline, which serve to transmit force to the stack. Notionally, plate p1 may be considered as being representative of guide tube 70 and plate p2 could be considered as being representative of tensioning cup 67.

FIG. 4 illustrates the friction ring stack in an unloaded condition. FIG. 5 illustrates the stack in a loaded condition where an applied force F has axially displaced the stack along axis 90 by a distance d. Such axial displacement is accompanied by sliding of the friction spring rings at their conical friction surfaces 85, 89 as shown in FIG. 3. Outer rings 88 are subjected to tension while inner rings 84, 86 are subjected to compression. Under maximum displacement or maximum design force, a condition which is not shown in FIG. 5, the plane surfaces of adjacent inner rings come in contact with each other to form a rigid cylindrical block.

Figure 6:
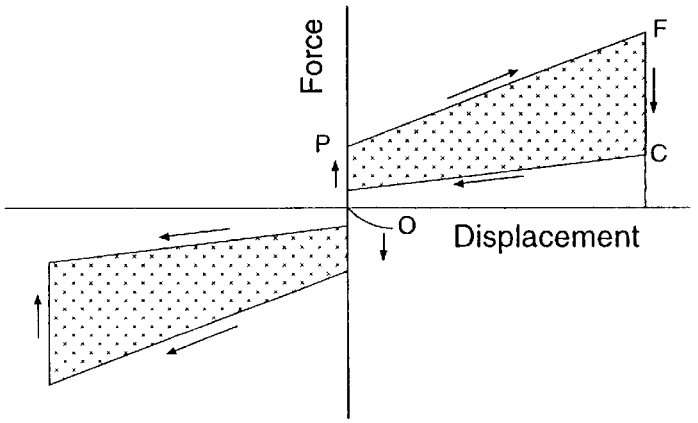
FIG. 6 is a hysteresis diagram illustrating characteristics of a friction spring EDU.

FIG. 6 is a hysteresis diagram which shows an idealized full deformation cycle for a typical friction spring EDU. Applied force is represented on the vertical axis, while displacement is represented on the horizontal axis. Loading and unloading paths in the hysteresis loop are indicated by arrows. The positive side of the displacement axis may be considered as representing behaviour under externally applied tension, while the negative side may be considered as representing behaviour under externally applied compression (the stack itself always remaining in compression).

In FIG. 6, P represents the magnitude of prestress applied to the stack, F represents an external applied force, and A represents displacement resulting from the external applied force Under loading, the area OPFA corresponds to the work done or energy input in deforming the EDU. The shaded area within either loop is a measure of the energy dissipated as heat due to friction spring at the conical friction surfaces of the friction rings. In a load-unload half cycle, about 66% of the input energy or work done on the friction spring rings can be dissipated as heat as the result of such friction.

Generally, the design of a friction spring EDU for use as part of the present invention will begin by estimating the maximum force that the EDU is to carry under earthquake conditions. Then, a few trials with data on spring force, ring size, and corresponding ring element displacement from the manufacturer of the friction rings will readily lead to a preliminary selection of the size and number of rings. With these parameters known, a dynamic analysis with a design earthquake input is then performed on the building structure utilizing techniques known to structural engineers.

In use, as a friction ring stack is loaded in compression, axial displacement will be accompanied by sliding of the rings at the conical friction surfaces. Outer rings 88 will experience tension while inner rings 84, 86 will experience compression. For the purpose of designing a friction spring EDU for a specific application, a ring element is considered to be one half of an inner ring 84 and one half of an outer ring 88 and the corresponding surfaces in conical friction contact that lie therebetween.

Depending on design requirements such as magnitudes of force and deformation, and damping, the configuration of components in a friction spring EDU may vary from the construction shown in FIG. 2. Thus, while the construction shown in FIG. 2 is a preferred design, it will be readily apparent to those skilled in the art that a number of different designs are possible; including designs which depart from that shown in FIG. 2 in relatively minor ways, and designs which depart from that shown in FIG. 2 in more significant ways.

Figure 7:
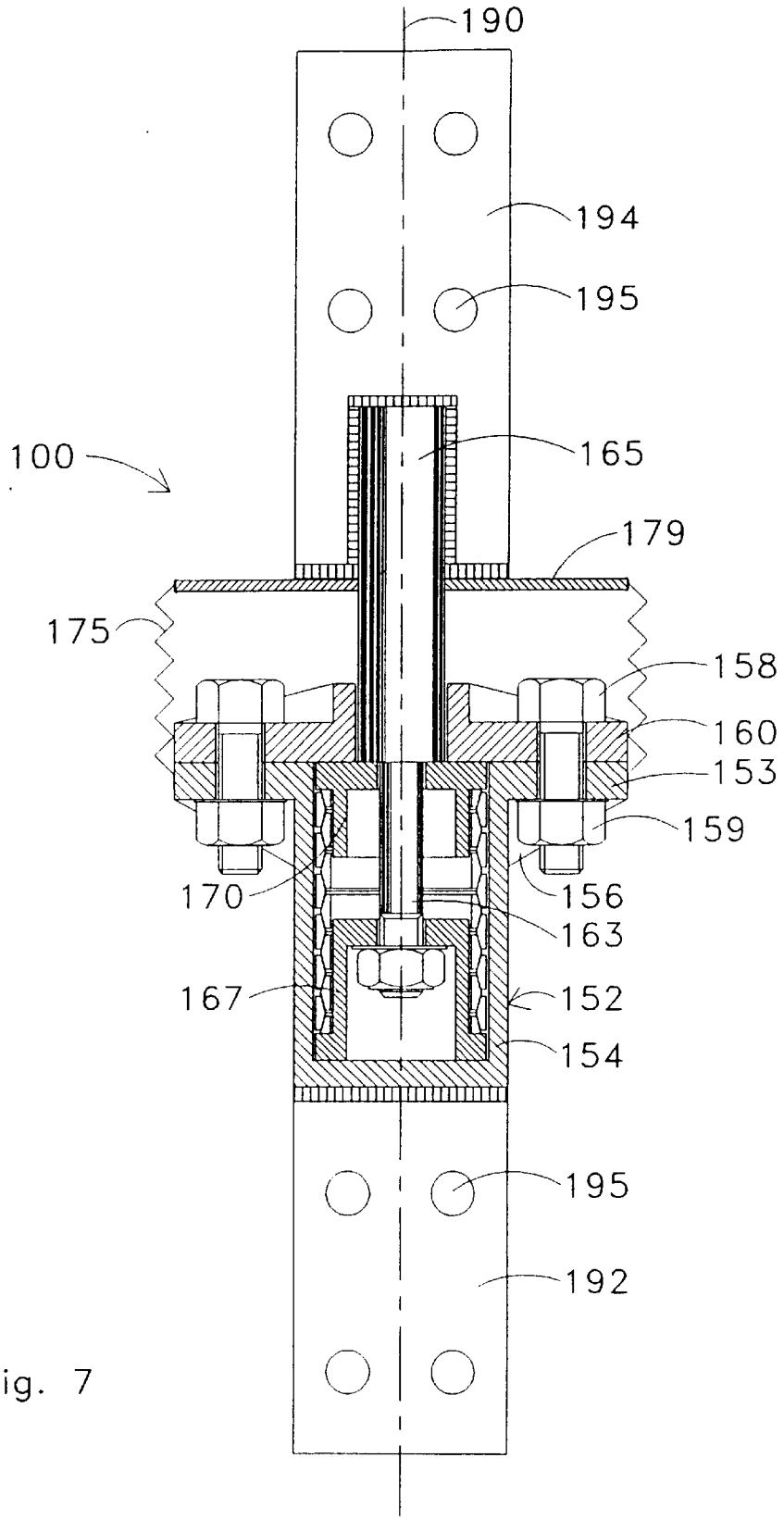
FIG. 7 is an elevation view, partially in section, of another friction spring EDU adapted for use in the bracing system of a building structure.

An example of a relatively minor design variation is illustrated by the friction spring EDU generally designated 100 illustrated in FIG. 7. The basic difference between EDU 100 shown in FIG. 7 and EDU 50 shown FIG. 2 lies in the construction of the cylindrical housing generally designated 152 forming part of EDU 100. Housing 152 includes an upper cylindrical portion 153 (essentially a flange) and a lower cylindrical portion 154. However, rather than a solid conical transition between the upper and lower portions as in the case of housing 52 of EDU 50, housing 152 includes stiffening members 156, only two of which are shown, spaced at angular intervals between the upper and lower portions at spaced intervals around the perimeter of the lower portion. The angular spacing between stiffening members 156 permits the use of nuts 159 and bolts 158 (only two of each being shown) which may be preferred by some designers to connect stiffened end plate 160 to housing 152. Otherwise, the construction of EDU 100 is basically the same as the construction of EDU. EDU 100 includes end connection plates 192, 194 extending along a longitudinal axis 190 of the unit, bolt holes 195 to facilitate installation in the bracing system of a building, a friction ring stack, tensioning cup 167, guide tube 170, tie rod 163, thrust rod 165, bellow 175 and sealing plate 179, all similar to that in EDU 50.

Figure 8:
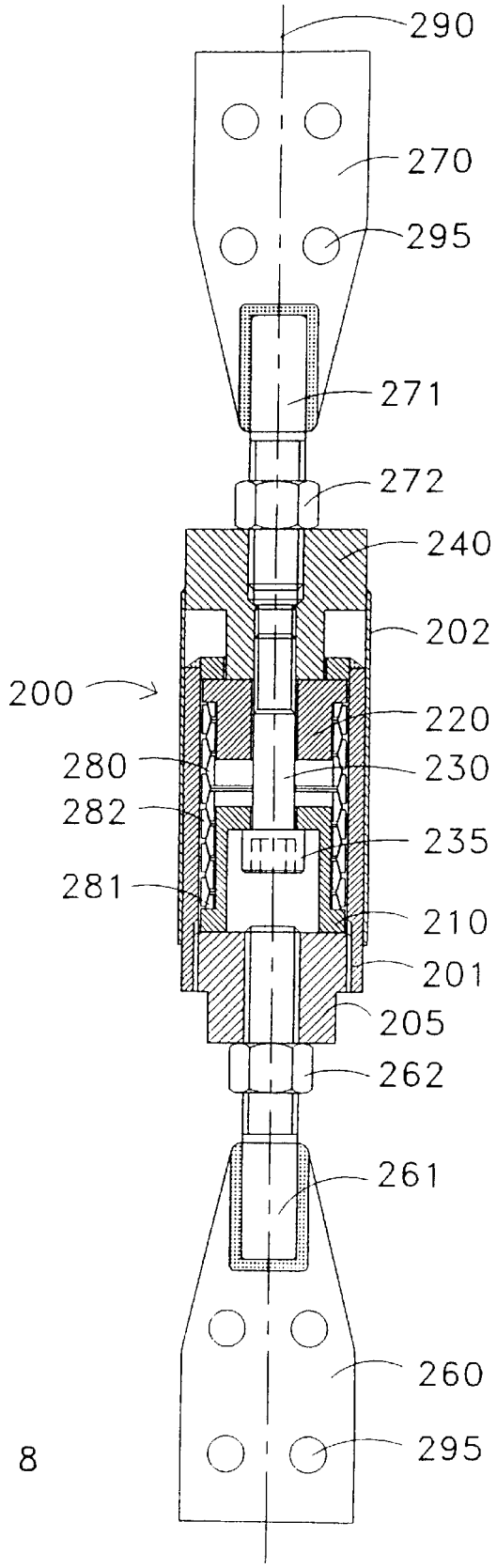
FIG. 8 is an elevation view, partially in section, of a further friction spring EDU adapted for use in the bracing system of a building structure.

FIG. 8 illustrates a friction spring EDU generally designated 200 having a compound housing comprising an inner cylindrical housing 201 partially telescoped within an outer cylindrical housing 202. A friction ring stack comprising inner and outer friction spring rings (inner rings 280, inner half rings 281, and outer rings 282) is supported within inner housing 201.

EDU 200 includes a tensioning cup 210, a guide tube 220, and a tie rod 230 which extends upwardly from lower head 235 and through cup 210 and tube 220 along longitudinal axis 290 of the EDU. Inner housing 201 is welded at its top end to a collar 225 which bears down on an outwardly extending flange of tube 220. The top end of housing 202 is closed by an end piece 240 which, in a manner similar to thrust rod 65 of EDU 50, also bears down on the top of tube 220. The bottom end of housing 201 is closed by an end piece 205.

To facilitate installation in the bracing system of a building, EDU 200 includes a pair of connection plates or bars 260, 270 aligned with axis 290 at opposed ends of the EDU. Bar 260 is welded to a rod 261 threaded into end piece 205 and secured by nut 262. End piece 205 is threadingly engaged with inner housing 201. Bar 270 is welded to a rod 271 threaded into end piece 240 and secured by a nut 272. End piece 240 is welded at the top end of outer housing 202. Bars 260, 270 both include bolt holes 295 to facilitate installation in the bracing system of a building.

Generally, the principles of operation of EDU 200 are the same as those of EDU 50. However, the construction of EDU 200 is not considered as rugged as that of EDU 50. Accordingly, it may be considered suitable for use in the bracing system of a building only when the anticipated loading forces under earthquake conditions are relatively small.

Various modifications are possible to the building structures which have been described herein without departing from the principles of the present invention. Accordingly, the present invention should be understood as encompassing all such modifications as are within the spirit and scope of the claims which follow.

I claim:

1. For use in bracing a building structure having a framework, a friction spring energy dissipating unit for providing lateral load resistance for said structure and for frictionally dissipating seismic energy during earthquake activity, said unit comprising:

(a) first and second connection plates at opposed ends of said unit;

(b) a friction ring stack supported between said ends within a housing, said stack comprising a plurality of friction spring rings stacked with axial alignment around a longitudinal axis extending between said ends, each friction spring ring having a conical surface in frictional contact with a conical surface of each adjacent friction spring ring;

(c) means including a thrust rod for transmitting a compression force longitudinally applied to said unit through said connection plates from said plates to said stack as a compression force on said stack;

(d) means including said thrust rod for transmitting a tension force longitudinally applied to said unit through said connection plates from said plates to said stack as a compression force on said stack;

(e) sealing means for sealing said housing, said sealing means including a bellow having one end sealingly connected to said housing and an opposed end sealingly connected to said thrust rod, and, (f) means for fixedly connecting said first and second connection plates to said framework.

2. A friction spring energy dissipating unit as defined in claim 1, said unit comprising means for sealing said housing, said sealing means including a bellow having a first end sealingly connected to said housing and an opposed second end sealingly connected to said thrust rod.

3. A friction spring energy dissipating unit as defined in claim 2, wherein said second end of said bellow is sealingly connected to said thrust rod by a sealing plate extending radially outward from said thrust rod.

* * * * *